US005626198A

United States Patent [19]

Peterson

[11] Patent Number: 5,626,198

[45] Date of Patent: May 6, 1997

[54] PNEUMATIC TORQUE IMPULSE TOOL

[75] Inventor: Lars M. Peterson, Nacka, Sweden

[73] Assignee: Atlas Copco Tools, Nacka, Sweden

[21] Appl. No.: 635,757

[22] Filed: Apr. 22, 1996

[30] Foreign Application Priority Data

Apr. 26, 1995 [SE] Sweden ..... 9501535

[51] Int. Cl.[6] ..... B25B 7/02; B25B 23/14

[52] U.S. Cl. ..... 173/93; 173/93.5; 173/177

[58] Field of Search ..... 173/93, 104, 93.5, 173/177; 91/59; 81/470

[56] References Cited

U.S. PATENT DOCUMENTS

| | | | |
|---|---|---|---|
| 3,253,662 | 5/1966 | Sacchini | 173/93 |
| 3,315,754 | 4/1967 | Holdo et al. . | |
| 3,323,395 | 6/1967 | Burnett et al. | 173/93 |
| 3,608,649 | 9/1971 | Roggenburk | 173/93.5 |
| 4,120,604 | 10/1978 | Garofalo | 173/177 |
| 4,418,764 | 12/1983 | Mizobe | 173/177 |
| 4,838,133 | 6/1989 | Dainin | 173/93.5 |
| 4,844,176 | 7/1989 | Podsobinski | 173/177 |
| 5,217,079 | 6/1993 | Kettner et al. | 173/177 |

FOREIGN PATENT DOCUMENTS

| | | |
|---|---|---|
| 0202130A1 | 11/1986 | European Pat. Off. . |
| 672512 | 3/1966 | France . |
| 934010 | 8/1963 | United Kingdom . |

*Primary Examiner*—Scott A. Smith

*Attorney, Agent, or Firm*—Frishauf, Holtz, Goodman, Langer & Chick

[57] ABSTRACT

A pneumatically powered torque impulse delivering tool for screw joint tightening comprises a housing (10) with a forward impulse chamber (11) enclosing a hydraulic impulse generator (15), a motor chamber (12) disposed rearwardly of the impulse chamber (11) and including a vane type air motor (19), and air inlet and outlet passages (26, 27) located at the rear end of the housing (10). The motor cylinder (20) is provided with radial air communication openings (37*a,b,* 38*a,b,* 39*a,b*) and outer grooves (37*c,d,* 38*c,d,* 39*c,d*) forming passages for connecting the openings (37*a,b,* 38*a,b,* 39*a,b*) to the air inlet and outlet passages (26, 27). Two pairs of openings (37*a,b,* 38*a,b*) are alternatively connected to the air inlet and outlet openings (26, 27) via rearwardly extending grooves (37*c,d,* 38*c,d*) and a reverse valve (31), whereas a third pair of openings (39*a,b*) permanently act as outlet openings and communicate with the impulse chamber (11) via forwardly extending grooves (39*c,d*), and at least one groove (41*a,b*) extending over the entire length of the cylinder (20) without coinciding with any one of the air communication openings (37*a,b,* 38*a,b,* 39*a,b*) and arranged to connect the impulse chamber (11) to the outlet passage (27).

3 Claims, 2 Drawing Sheets

PNEUMATIC TORQUE IMPULSE TOOL

BACKGROUND OF THE INVENTION

This invention relates to a pneumatically powered torque impulse delivering tool for tightening screw joints and the like.

In particular, the invention concerns an impulse tool which comprises a housing with a forward impulse chamber, a rear motor chamber with a cylindrical inner wall and including a vane type air motor, air inlet and outlet passages extending from the rear end of the motor, a hydraulic impulse generator rotatively supported in the impulse chamber, wherein the motor includes a cylinder with three or more air communication openings whereof at least one permanently acts as an outlet opening means, and a vane carrying rotor drivingly connected to the impulse generator.

In tools of the above type, there is always a problem to obtain an efficient enough cooling of the impulse generator, because heat generated during operation of the tool tends to expand the fluid volume in the impulse generator such that leakage occurs, and when the tool is cooling down after a period of use air penetrates into the impulse generator. The output power of the tool is drastically impaired by air sucked into the impulse generator in this way.

A previously known way of solving this heat problem is to use the cold exhaust air from the air motor to transport heat from the impulse generator to the outside of the tool housing. An example on that is illustrated in U.S. Pat. No. 4,418,764. The tool shown in this patent is of the pistol handle type in which the housing is formed with an exhaust air passage that extends from the motor, past the impulse generator and out into the atmosphere via outlet openings at the forward end of the tool housing. The exhaust passage extends from a number of outlet openings on the motor cylinder and through cavities formed in the housing, and since there is no particular requirement in a pistol type tool to keep down the outer diameter of the housing, it has been easy just to design the casting of the housing to comprise the space necessary to accomplish a desired exhaust air flow.

In the straight type of tools, however, i.e. tools without a pistol grip handle, the outer diameter of the tool housing has to be kept relatively small to offer a comfortable grip for the operator. When in such tools it also becomes desireable to arrange air passages not only to and from openings in the motor cylinder, but past the motor from the impulse chamber to an exhaust passage at the rear end of the tool, there is a problem to obtain passages with large enough flow areas. By using the technique illustrated in the above referred U.S. patent, namely to form the passages on the inside of the housing, by casting, the manufacturing costs of the tool would be considerably increased compared to presently available tools of the straight type.

On the other hand, if the air passages for the above described cooling purposes were formed on the inside of the housing by milling or similar working, which is a commonly used method at manufacturing housings for the straight type of tools, the air passage areas would be too small or a more slender motor should have to be used for a given desired outer diameter of the housing. This method would also result in a heavier housing with smaller and less effective seal portions between the passages. In particular, this would be the case when using a reversible twin chamber type of vane motor which has a larger number of air communication openings than the commonly used single chamber type motor.

SUMMARY OF THE INVENTION

The main object of the invention is to accomplish an improved pneumatic torque impulse delivering tool in which air communication passages to, from and past the air motor provide not only large enough flow areas but optimize the motor size in relation to the outer diameter of the tool housing, in particular when using a reversible twin chamber type vane motor.

A preferred embodiment of the invention is described below with reference to the accompanying drawings.

DESCRIPTION OF THE PREFERRED EMBODIMENT

Figure 1:
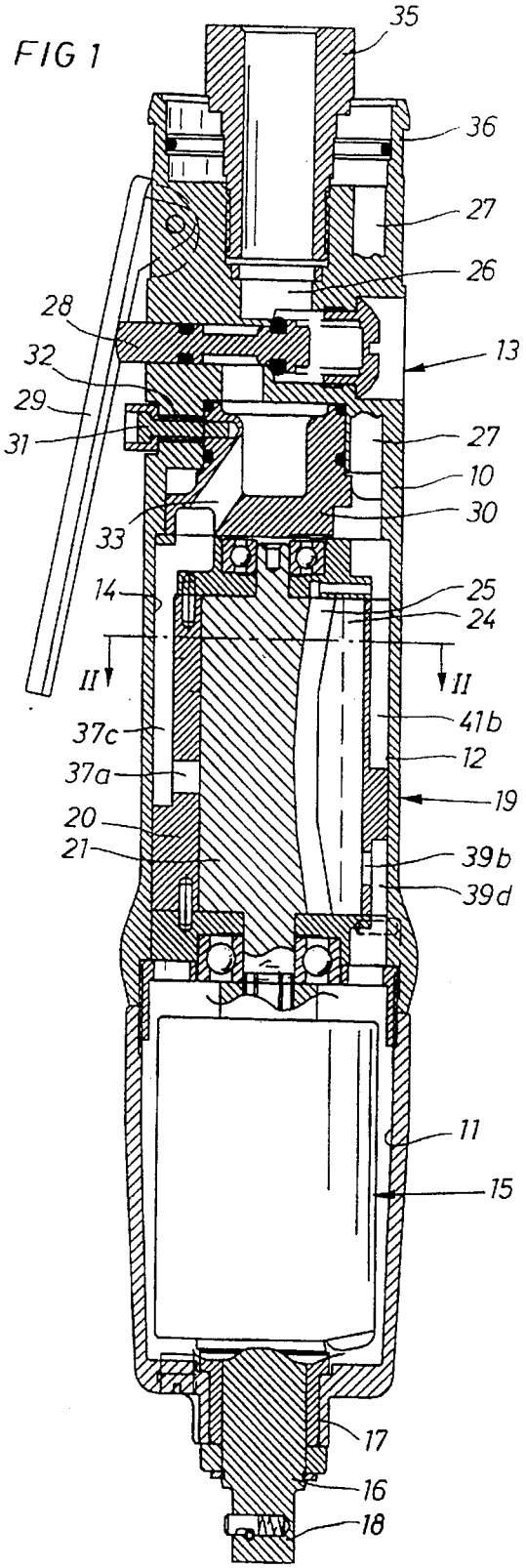
FIG. 1 shows a longitudinal section of an impulse tool according to the invention.

The tool shown in FIG. 1 comprises a housing 10 with a forward impulse chamber 11, a motor chamber 12, and a rear air communication section 13.

In the impulse chamber 11 there is rotatively supported a hydraulic torque impulse generator 15 which has an output shaft 16 extending out of the housing 10 through a front opening 17. The output shaft 16 is formed with a square end 18 for carrying a nut socket (not shown). The impulse generator 15 is of a conventional design, and since it is not in itself a part of the invention it is not described in detail.

Figure 2:
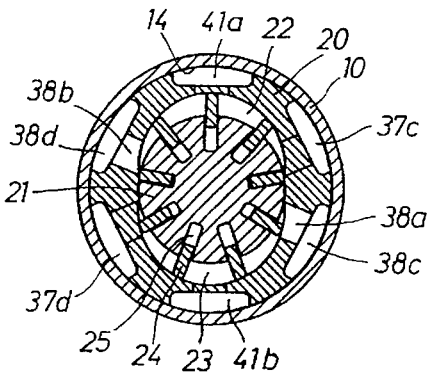
FIG. 2 shows a cross section along line II—II in FIG. 1.

The motor chamber 12 comprises a cylindrical wall 14 and encloses a vane type rotation motor 19. The latter includes a cylinder 20 rigidly secured in the housing 10 and a rotor 21. As illustrated in FIG. 2, the motor 19 is of the twin chamber type comprising two working chambers 22, 23 and a number of vanes 24 slidably supported in slots 25 in the rotor 21. At its forward end, the rotor 21 is drivingly connected to the impulse generator 15.

The air communication section 13 of the housing 10 comprises an air inlet passage 26, an air outlet passage 27, a throttle valve 28 operable by a lever 29, and a reversing valve 30. The latter is rotatively supported in the housing 10 and provided with a radial maneouver pin 31 for shifting between a "forward" position and a "reverse" position. Thereby, the pin 31 is movable in a part-circular slot 32 in the housing 10, and two air distribution passages 33 in the reversing valve 30, one only of which is shown in FIG. 1, are connected alternatively to two pairs of air communication openings in the motor 11. This is described in further detail below.

At the rear end of the tool, there is provided a central tubular connection member 35 for connection of a pressure air conduit. The connection member 35 is encircled by the exit end of the air outlet passage 27, and the rear end of the tool housing 10 is formed with an external socket portion 36 for connection of an outlet duct, if desired.

The motor cylinder 20 comprises a number of radial air communication openings which are grouped in pairs, namely a first pair of alternative inlet and outlet openings 37*a,b*, a second pair of alternative inlet and outlet openings 38*a,b*, and a third pair of openings 39*a,b* permanently acting as outlet openings. The latter pair of openings 39*a,b* is normally called primary outlets in vane motor terminology. See FIGS. 3 and 4.

The first and second pairs of openings 37*a,b* and 38*a,b*, respectively, communicate with the rear end of the cylinder 20 via passages 37*c,d* and 38*c,d*, respectively, whereas the third pair of openings 39*a,b* communicates with the forward end of the cylinder 20 via passages 39*c,d*.

Two further passages 41*a,b* on the outside of the cylinder 20 interconnect the forward end of the cylinder 20 and the rear end thereof without coinciding with anyone of the air communication openings in the cylinder 20.

All of the above described passages 37*c,d*, 38*c,d*, and 41*a,b* are defined by grooves formed, for instance by milling, on the outer surface of the cylinder 20 and the inner cylindrical surface 14 of the motor chamber 12. See FIG. 2.

In operation of the tool, a pressure air conduit is connected to the connection member 35 for supplying motive pressure air to the motor 19, and a nut socket is attached to the output shaft 16 for connection to a screw joint to be tightened.

The tool housing 10 is grasped by the operator and the throttle valve 28 is opened by pressing the lever 29. Depending on the actual position of the reversing valve 30, the motor 19 starts rotating in a clockwise or anticlockwise direction, thereby delivering rotation power to the impulse generator 15. Arrows in FIGS. 3 and 4 illustrate alternative directions of rotation.

In its one position, for instance its "forward" position, the reversing valve 30 feeds pressure air to the first pair of air communication openings 37*a,b*, whereas the second pair of openings 38*a,b* in the motor cylinder 20 are connected to the outlet passage 27. Accordingly, the first pair of openings 37*a,b* act as inlet openings, whereas the second pair of openings 38*a,b* act as outlet openings. In fact the second pair of openings 38*a,b* act as secondary outlets, because the third pair of openings 39*a,b* permanently act as primary outlets.

Figure 3:
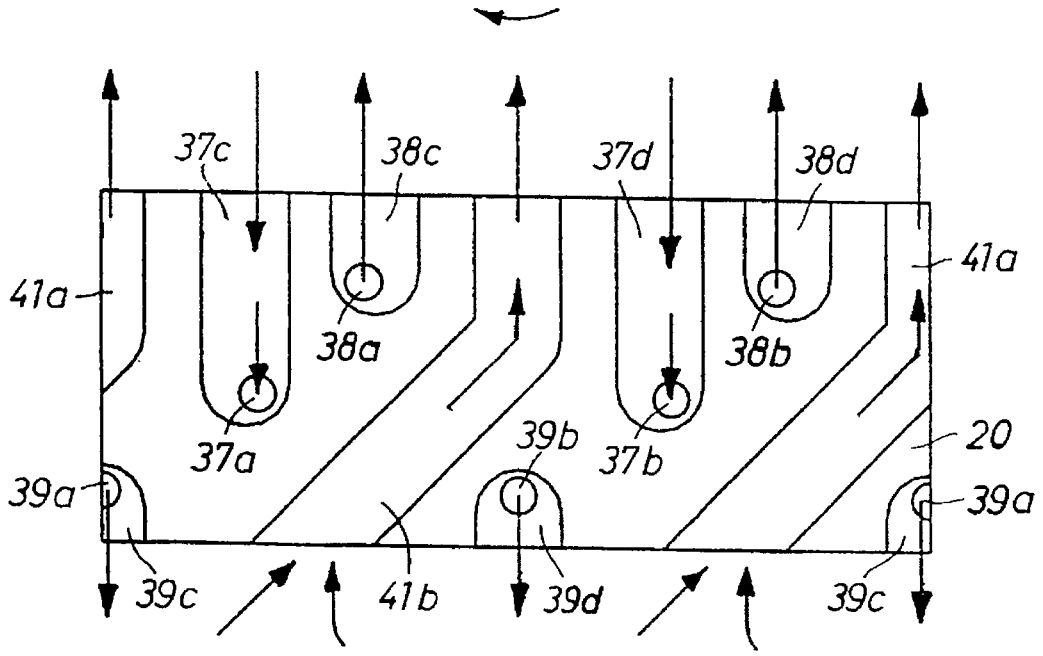
FIG. 3 shows a spread-out projection of a motor cylinder according to the invention with arrows illustrating the air flow paths at motor operation.
Figure 4:
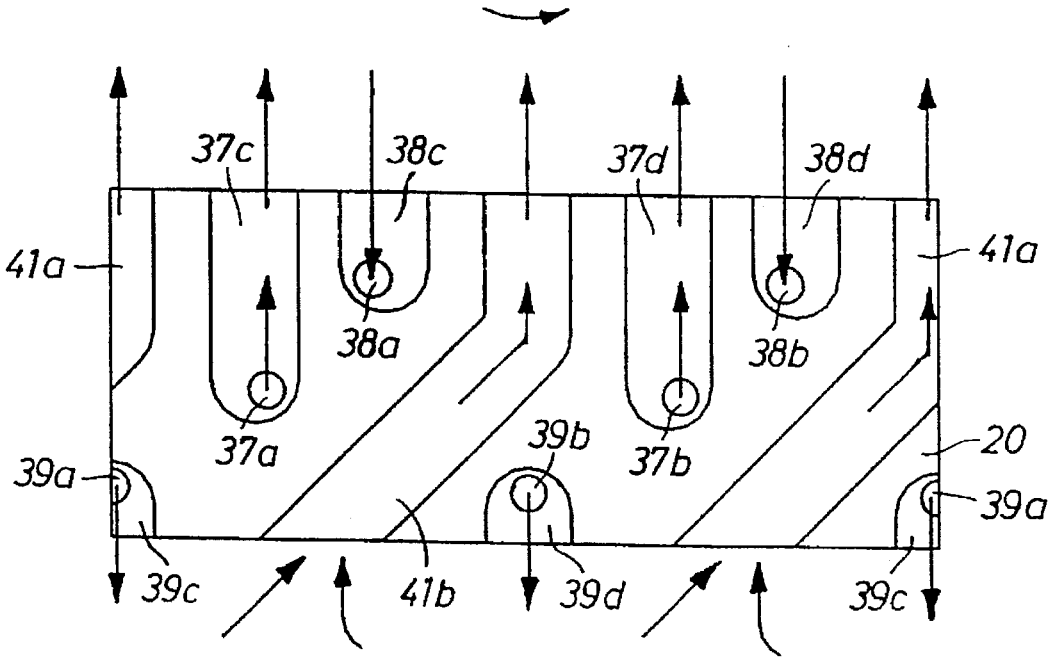
FIG. 4 shows the same projection as in FIG. 3, but with arrows illustrating the air flow paths at the opposite direction of motor rotation.

As schematically illustrated by arrows in FIG. 3, the pressure air supplied via the reversing valve 30 is ducted to the openings 37*a,b* through the passages 37*c,d*, and exhaust air leaving the motor through the opening 38*a,b* is ducted rearwardly via the passages 38*c,d* and the reversing valve 30 to the outlet passage 27.

The exhaust air leaving the motor 19 through the third pair of openings 39*a,b* is ducted forwardly through the passages 39*c,d* and into the impulse chamber 11. From there on the exhaust air is ducted to the rear end of the motor 19 and to the outlet passage 27 via the passages 41*a,b*. During its circulation through the impulse chamber 11, the cold exhaust air absorbes heat from the impulse generator 15 and transports that heat out of the tool.

When desired to operate the tool in the opposite direction, the reversing valve 30 is shifted to its other position, i.e. its "reverse" position, whereby pressure air is fed to the second pair of openings 38*a,b*. See FIG. 4. In this operation mode, the first pair of openings 37*a,b* act as secondary outlets and communicate with the outlet passage 27 via the passages 37*c,d* and the reversing valve 30. In this case too, the third pair of openings 39*a,b* act as primary outlets and direct cold exhaust air into the impulse chamber 11 via passages 39*c,d* to keep down the temperature of the impulse unit 15.

By forming the air communication passages 37*c,d*, 38*c,d*, 39*c,d*, and 41*a,b* on the outer surface of the motor cylinder 20, it is possible to obtain large air flow areas including a rearwardly directed exhaust air flow at low manufacturing costs of the tool and at maintained favourable dimensions of the housing and the motor.

We claim:

1. A pneumatic torque impulse tool, comprising a housing (10) with an impulse chamber (11) at a forward end thereof, a motor chamber (12) having a cylindrical wall (14) and disposed rearwardly of said impulse chamber (11), a vane type rotation motor (19) disposed in said motor chamber (12), an air inlet passage (26), and an air outlet passage (27), both of said air inlet and outlet passages (26, 27) communicating with a rear end of said motor (19), a hydraulic impulse generator (15) rotatively supported in said impulse chamber (11), said motor (19) including a cylinder (20) and a vane carrying rotor (21) drivingly connected to said impulse generator (15), said cylinder (20) having three or more radial air communication openings (37*a,b*, 38*a,b*, 39*a,b*), at least one (39*a,b*) of which permanently acts as an outlet opening means, wherein:

said cylinder (20) is formed with external grooves (37*c,d*, 38*c,d*, 39*c,d*, 41*a,b*) extending from either ends of said cylinder (20) and which define together with said cylindrical wall (14) parts of said air inlet and outlet passages (26, 27), each one of said air communication openings (37*a,b*, 38*a,b*, 39*a,b*) is separately located in one of said grooves (37*c,d*, 38*c,d*, 39*c,d*), said at least one air communication opening (39*a,b*) permanently acting as an outlet opening means is located in one of said grooves (39*c,d*) extending from the forward end of said cylinder (20) and communicating with said impulse chamber (11), whereas the other ones (37*a,b*, 38*a,b*) of said air communicating openings are located in those of said grooves (37*c,d*, 38*c,d*) extending from the rear end of said cylinder (20), and at least one (41*a,b*) of said grooves extends over the entire length of said cylinder (20) without coinciding with any one of said air communication openings (37*a,b*, 38*a,b*, 39*a,b*), thereby connecting said impulse chamber (11) to said air outlet passage (27).

2. Impulse tool according to claim 1, wherein said motor (19) is of the reversible type in which at least two (37*a,b*, 38*a,b*) of said air communication openings are alternatively connectable to said inlet passage (26) and said outlet passage (27) via those (37*c,d*, 38*c,d*) of said grooves that extend from the rear end of said cylinder (20) and via a rotation direction shifting valve 30).

3. Impulse tool according to claim 2, wherein said motor (19) is of the twin chamber type in which two pairs (37*a,b*, 38*a,b*) of said air communication openings via two pairs (37*c,d*, 38*c,d*) of said grooves are alternatively connectable in pairs to said inlet passage (26) and said outlet passage (27), said at least one air communication opening (39*a,b*) permanently acting as outlet opening means is formed by a third pair of said air communication openings, and said at least one groove (39*c,d*) extending from the forward end of said cylinder (20) comprises a pair of grooves coinciding with said third pair (39*a,b*) of said air communicating openings.

* * * * *